United States Patent [19]

Murray

[11] 4,021,088

[45] May 3, 1977

[54] DISH STABILIZER FOR DISH WASHING MACHINES

[76] Inventor: James M. Murray, 9129 S. Crescent Court, Oak Lawn, Ill. 60453

[22] Filed: Apr. 7, 1976

[21] Appl. No.: 674,681

[52] U.S. Cl. ..... 312/311; 312/270; 312/273; 134/135

[51] Int. Cl.[2] ..... B08B 3/00; A47L 15/00

[58] Field of Search ..... 312/311, 273, 270, 319; 134/199, 135; 211/181

[56] References Cited

UNITED STATES PATENTS

| | | | |
|---|---|---|---|
| 589,159 | 8/1897 | Burt | 312/270 |
| 1,120,028 | 12/1914 | Cole | 312/270 |
| 2,163,865 | 6/1939 | Bitney | 211/181 |
| 2,660,180 | 11/1953 | Endicott et al. | 312/270 |
| 3,361,509 | 1/1968 | Levenberg | 312/319 |
| 3,616,806 | 11/1971 | Randall | 134/199 |
| 3,650,590 | 3/1972 | Frederick et al. | 312/319 |
| 3,799,640 | 3/1974 | Jacobs | 312/311 |

*Primary Examiner*—Paul R. Gilliam
*Assistant Examiner*—Victor N. Sakran

[57] ABSTRACT

An installation in a dish washing machine to lower a limp mesh on dishes loaded in each work-basket thereof, such mesh settling on and between the dishes during the rearward travel of the work-basket to stabilize the dishes during the dish washing operation. The installation involves a horizontal looped drive operated by each work-basket and a mesh-supporting conveyor companion to and actuated by the said drive. The mesh is attached at the rear to the conveyor, and with its front end to the work-basket. It is drawn by and over the work-basket on the rearward travel thereof; and the conveyor has an overdrive to advance the mesh with sufficient slack to settle as stated.

3 Claims, 3 Drawing Figures

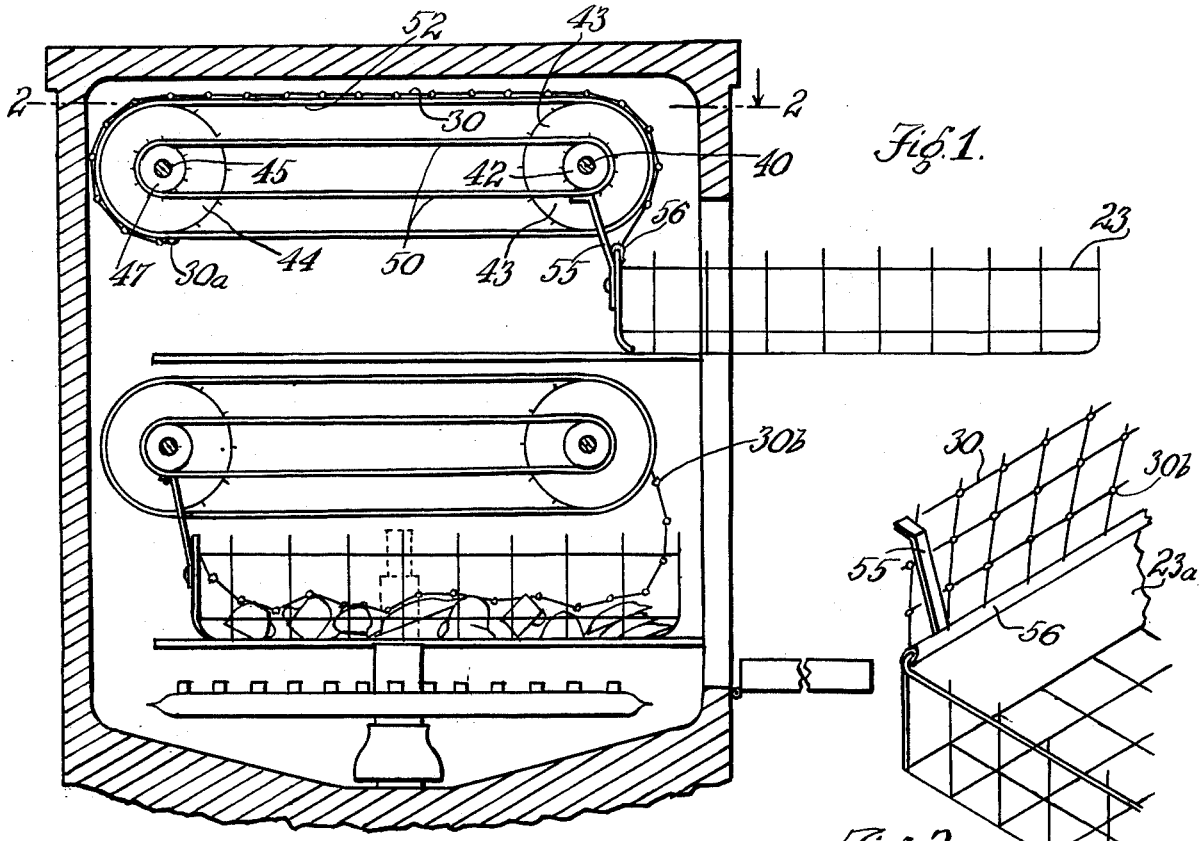
Fig. 1.
Fig. 3.
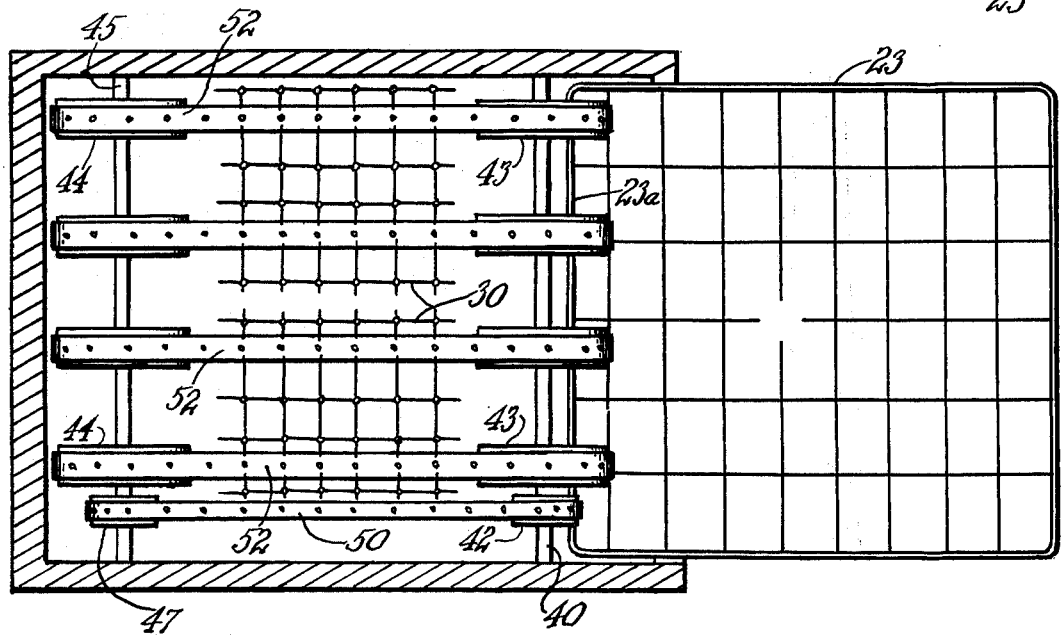
Fig. 2.

DISH STABILIZER FOR DISH WASHING MACHINES

This invention relates to automatic dish washing machines, and more particularly to means for stabilizing dishes deposited in the work-baskets of such machines. A previous form of such means is illustrated and described in my co-pending application filed on Feb. 14, 1975 under Ser. No. 550,004. The disclosure in that application deals with a limp mesh carried by a belt drive over the space in the dish washing machine into which each work-basket loaded with dishes is insertible; and the belt drive allows the mesh to sink of its own weight into the array of dishes in the work-basket as the latter is inserted into the machine, the mesh draping over and between the dishes in such event to hold them down and in spaced relation.

An improved structure to accomplish the above operation is illustrated in the accompanying drawing, in which FIG. 1 is a side view of the interior of a dish washing machine similar to FIG. 1 in my aforesaid application, except that the positions of the work-baskets are reversed;

FIG. 2 is a section on the line 2—2 of FIG. 1; and

FIG. 3 is a fragment in perspective of the showing in the upper right-hand corner of FIG. 1.

Referring specifically to the drawing, the numerals identifying the parts are generally identical with those in my aforesaid application. However, the upper work-basket 23 is now shown in extended position, such as for loading with dishes; and the lower work-basket shows that it has been loaded with dishes and inserted into the dish washing machine. Referring specifically to the drawing, the mechanism for each work-basket to operate the limp mesh as first stated originates with a pair of front and rear cross-shafts 40 and 45 which carry a set of fixed pulleys 42 and 47, respectively; and these pulleys are spanned by a drive belt 50. The rear shaft 45 also carries a pair of fixed pulleys 44, while the frontal shaft 40 carries loose pulleys 43 in line with the fixed ones; and a pair of belts 52 spans the loose pulleys 43 and the fixed pulleys 44, and is designed to carry the limp mesh 30. The fixed pulleys 44 are of greater diameter than the fixed pulleys 42 and 47 of the belt drives 42-47-50. Since the two belt drives 43-44-52 are widely spaced — as seen in FIG. 2 - similar intermediate drives are provided to prevent the sagging of the mesh 30 when in the overhead position.

When a work-basket 23 is in the extended position, as shown in the uper right-hand portion of FIG. 1, one strut 55 rises from its rear end wall **23*a* to connect underneath the front with the drive belt 50; and the limp mesh 30 overlies the belts 52 as seen in the top portion of FIG. 1. One end of the mesh rounds the belts at the rear to connect with them underneath as seen at 30*a*, while the front end of the mesh now applies directly across the rear wall 23*a* of the work-basket as seen in FIG. 3, and is attached thereto by clips 56 or other removable attaching means. The mesh is preferably made up of limp tapes or strings of fabric with weights 30*b*** attached thereto.

When a work-basket loaded with dishes to be cleaned is pushed into the dish washing machine, its strut 55 pulls on the belt 50 a distance exchanging its runs. At the same time the work-basket draws the right-hand end of the mesh in rearward direction at the speed of the belt drive 42-47-50, since the work-basket is connected to the same by the strut 55, However, the larger rear pulleys 44 push the mesh forwardly at a faster rate than it is drawn rearwardly underneath. The mesh therefore assumes a progressive sag into the work-basket, and gradually covers the dishes, draping between them as indicated in the lower part of FIG. 1. It follows, when the dishes have been cleaned and the work-basket is being withdrawn from the dish washing machine, that the above operation is reversed, and that the mesh returns to the overhead position.

It is noted now that one improvement consists in the economy of a single belt conveying means for the application, removal and storage of the mesh instead of the two differential speed conveyors described in my pending application. However, the conveyor drive means is the same in both cases. Further, the leading end of the mesh is now connected to and receives the direct pull of the work-basket as its driving source. Also, when so connected, the mesh forms a backstop rising from the rear wall of the work-basket to check the tendency of dishes to fall out of the work-basket as it is pushed into or drawn out of the dish washing machine, or accidentally while the work-basket is being loaded or unloaded. The present improvements are therefore designed for economy and more reliable operation.

I claim:

1. A stabilizer for dishes contained in the work-basket of a dish washing machine comprising a limp mesh designed to be lowered on the dishes, a substantially horizontal looped drive means between the front and rear of the dish washing machine, a connection between the workbasket and the drive means to exchange its runs when the work-basket is pushed into the dish washing machine, an endless belt conveyor with one end of said mesh extending over the upper run thereof and attached to said conveyor, the other end of the mesh having a connection with the work-basket to be drawn rearwardly when the latter is pushed as stated, and the conveyor having an overdrive to lower the mesh with slack on and between the dishes during their rearward travel.

2. The structure of claim 1, the mesh portion above said other end forming a backstop to check the escape of dishes from the rear of the work-basket.

3. The structure of claim 1, the work-basket having a rear wall, and the second-mentioned connection being detachable fastening means.

* * * * *